US005411414A

United States Patent [19]

House et al.

[11] Patent Number: 5,411,414

[45] Date of Patent: May 2, 1995

[54] ELECTRICAL CONNECTOR

[75] Inventors: Jeff House, Olathe; David McCormick, Lenexa; George McCoy, Olathe, all of Kans.

[73] Assignee: Premier Telecom Products, Inc., Industrial Airport, Kans.

[21] Appl. No.: 107,932

[22] Filed: Aug. 17, 1993

[51] Int. Cl.[6] ..... H01R 13/60

[52] U.S. Cl. ..... 439/540; 439/676

[58] Field of Search ..... 439/535, 536, 590, 676

[56] References Cited

U.S. PATENT DOCUMENTS

| | | | |
|---|---|---|---|
| Re. 31,714 | 10/1984 | Knickerbocker . | |
| D. 326,047 | 5/1992 | Bodenweiser et al. . | |
| 3,227,991 | 1/1966 | Zdanis . | |
| 3,611,264 | 10/1971 | Ellis . | |
| 3,798,587 | 3/1974 | Ellis . | |
| 4,084,877 | 4/1978 | Knickerbocker . | |
| 4,118,095 | 10/1978 | Berglund et al. . | |
| 4,150,867 | 4/1979 | Knickerbocker . | |
| 4,533,195 | 8/1985 | Knickerbocker . | |
| 4,580,864 | 4/1986 | Knickerbocker . | |
| 4,725,249 | 2/1988 | Blackwood et al. . | |
| 4,738,635 | 4/1988 | Harrington et al. . | |
| 4,820,192 | 4/1989 | Denkmann et al. . | |
| 4,865,564 | 9/1989 | Denkmann et al. . | |
| 4,909,753 | 3/1990 | Siemon et al. . | |
| 4,964,812 | 10/1990 | Siemon et al. . | |
| 5,041,018 | 8/1991 | Arnett . | |
| 5,055,067 | 10/1991 | Field | 439/540 |
| 5,096,439 | 3/1992 | Arnett . | |
| 5,096,442 | 3/1992 | Arnett et al. . | |
| 5,106,325 | 4/1992 | Robinson | 439/540 |
| 5,125,852 | 6/1992 | Archer | 439/536 X |
| 5,131,866 | 7/1992 | Bodenweiser et al. . | |
| 5,167,530 | 12/1992 | Waugren et al. | 439/540 |
| 5,186,647 | 2/1993 | Denkmann et al. . | |

*Primary Examiner*—Eugene F. Desmond

*Attorney, Agent, or Firm*—Kokjer, Kircher, Bowman & Johnson

[57] ABSTRACT

A modular connector for modular data communication comprises a socket member located in a module. The module has a base for supporting the socket member. A connecting member for connecting thereto a connecting block is oriented on the base at an acute angle relative to the orientation of the base and socket member therein. In the preferred embodiment, a first face of the modular connector has a socket opening for plugging therein a modular plug. A second face of the modular connector, opposite the first face, has a row of posts with a longitudinal axis which is aligned substantially diagonally across the face. Such an arrangement permits two independent modular connectors to be placed side-by-side within a standard electrical box.

18 Claims, 3 Drawing Sheets

ELECTRICAL CONNECTOR

BACKGROUND OF THE INVENTION

1. Field of the Invention

The present invention relates in general to an electrical connector. In particular, the present invention relates to an improved modular connector for electrically connecting hardware for conducting data communication signals of the type transmitted and received by telecommunications equipment, by computers and peripheral devices, and the like.

2. Description of the Related Art

Modular data communication has gained widespread adoption in the telecommunications industry. For instance, modular electrical wiring techniques are commonly used for telephones, telefacsimile devices, computers, and various other devices which may be peripherally attached to telecommunications equipment or computers. More specifically, the modular wiring techniques commonly used employ standard module sockets, often called jacks, which are adapted to receive data communication plugs of the type regularly found at the end of telephone cords.

In a typical system, such as for example in an office complex, telecommunications cables enter a distribution block which may comprise patch panels and cross connects. Individual telephones or other devices within the office complex are connected to the distribution block. The present invention is directed to an electrical connector assembly for providing modular data communication in such a system. Particularly, connector devices constructed in accordance with the present invention are adapted for use at either individual user locations, such as at an outlet at an office work station, at a patch panel, or in other locations where a modular connector is needed or desired.

One of the primary problems with use of modular jack electrical connector assemblies has been their size and shape and the space which they occupy. Particularly problematic has been the inability to position two individual modular jack assemblies side-by-side within the confines of a standard electrical box of the type commonly used at electrical outlets. Space and size problems associated with modular jack usage is illustrated by U.S. Pat. No. 5,131,866, which discloses a singular electrical connector which has two sockets (i.e., jacks) mounted side-by-side in a single module.

The versatility and the applications available for a device having two sockets mounted within one module are limited. For instance, the device, which requires more components and is therefore more costly to make than a single-jack module, is not suitable where only one modular jack is desired. Additionally, both sockets will accompany the module when the module is removed, although perhaps it is desired to remove, rewire, or replace only one of the sockets.

A side-by-side arrangement of individual connector assemblies is desirable in that it maximizes use of the space within a standard electrical box. Moreover, a connector assembly which is dimensioned to permit two such assemblies, which are entirely structurally independent of each other, to be positioned side-by-side within a standard electrical box would enhance flexibility in setting up a system. The present invention provides an individual electrical connector assembly which will permit such an arrangement.

SUMMARY OF THE INVENTION

An object of the present invention is to provide a versatile electrical connector assembly for conducting modular data.

Another object of the present invention is to provide an inexpensive electrical connector assembly which may be easily used in an electrical box at an outlet or at a patch panel.

A further object of the present invention is to provide an electrical connector assembly for conducting data signals which is space efficient, and particularly will fit side-by-side with a second electrical connector assembly made in accordance with the principles of this invention in a standard electrical box.

A further object of the present invention is to provide an electrical connector for modular data communication which means for supporting a connecting block, which support means are oriented at an acute angle in relation to the socket member or socket opening.

These and other objects are achieved by an electrical connector assembly for modular data communication generally comprising a module which houses a standard modular jack. The module substantially comprises a box-like housing in which the modular jack is located. The modular jack is accessible at an open frontal face of the housing for receiving a data communications plug. Tabs are provided on the module for connecting the module to an object, such as a patch panel or the rear of a faceplate which may be used for covering the electrical box at an outlet.

Support means are located on the housing to which a connector may be coupled. Particularly, support means for supporting a suitable connecting block and for coupling the modular jack to the connecting block is positioned substantially diagonally on the rear face of the housing. The support means generally comprises a row of outwardly extending tabs to which a connecting block, such as a connecting block known by part number 110c or 110d by AT&T Corporation, is coupled. The diagonal arrangement of the support means optimizes use of the space available on the module for coupling of the connector. Particularly, such an arrangement makes it possible for two individual connector assembly units of the present invention to fit side-by-side in a standard electrical box. When assembled, the connector assembly of the present invention is appropriately wired to provide electrical connection the modular jack and the support means, and more particularly to provide modular data transmission between the data communications plug inserted into the modular jack and the connecting block.

The size and geometry of the modular connector of the present invention permit two modular connectors to be placed side-by-side in a standard electrical box. Additionally, the modular connector of the present invention is suitable where only one socket is desired. Later, if additional sockets are desired, they can be added, even along side the modular jack assembly already in place in a standard electrical box, if an appropriate face plate is employed at the outlet. Moreover, flexibility in the performance levels of different sockets is easily obtained since appropriate technology for handling the desired rate of data transmission may be individually selected for each socket location. Further, replacing a particular individual socket member does not necessitate removing additional socket members.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
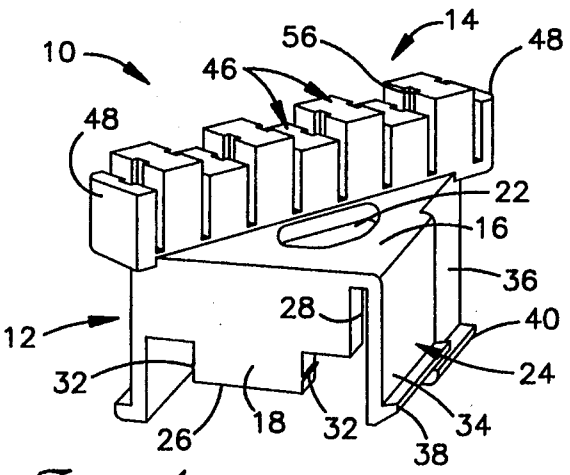
FIG. 1 is a top-rear perspective view of a preferred embodiment of a modular connector of the present invention.

With reference initially to FIGS. 1–6, the preferred embodiment of the present invention is shown and described. Throughout this description, for purposes of illustration and description only, references are made to relative locations, such as "top", "bottom", "front", "rear", etc. However, it should be understood that any such references are for illustrative purposes only, and that the modular connector of the present invention may be rotated and positioned for use in any manner.

Module 10 comprises a base portion 12 and a connecting member, generally denoted by the numeral 14. In general, base portion 12 comprises a rear wall 16 and a plurality of side walls extending from rear wall 16, leaving a substantially open front face of base portion 12. As such, module 10 is adapted to receive and substantially house a socket member for modular data transmission (not shown in FIG. 1), and accordingly, top wall 18 and bottom wall 20 (See FIG. 4) are configured for interlocking receipt of the socket member utilized in accordance with the present invention. It should be understood that the socket member is of the type having a row of electrical contacts therein for conducting modular data through a modular data plug of the type typically utilized on a telephone cord. The socket member is accessible through the open front face of base portion 12. As discussed in greater detail below, rear wall 16 of base portion 12 has an aperture 22.

Figure 4:
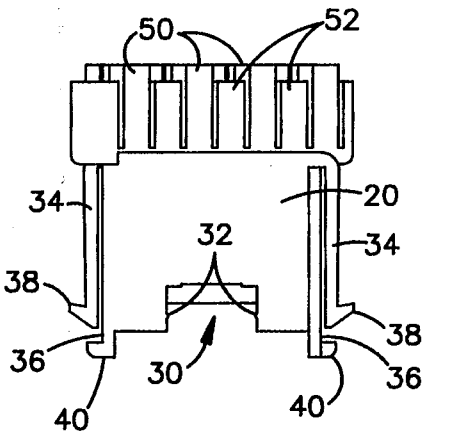
FIG. 4 is a top view of the modular connector shown in FIG. 1.
Figure 5:
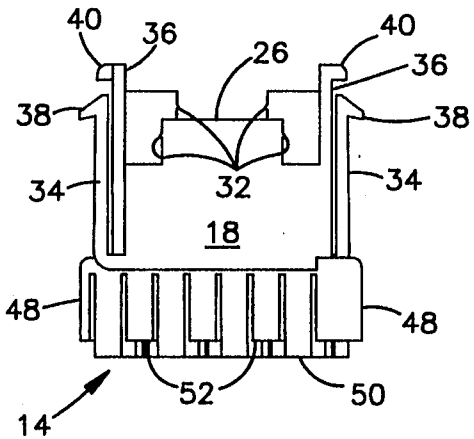
FIG. 5 is a rear bottom view of the modular connector shown in FIG. 1.
Figure 6:
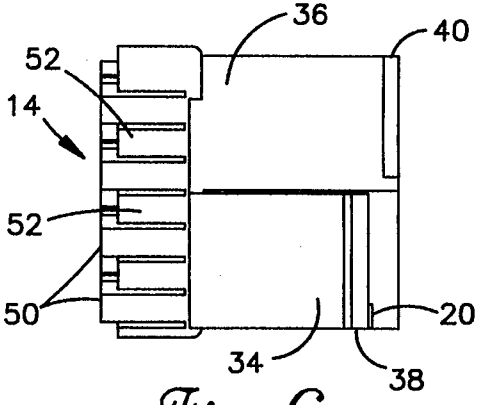
FIG. 6 is a left side elevational view of the modular connector shown in FIG. 1.

More specifically, as shown in FIGS. 1 and 5, top wall 18 is preferably shaped such that it extends outwardly away from rear wall 16 to a lesser extent than do side walls 24. Top wall 18 has a portion 26 intermediate the walls. A channel 28, in which a portion of the socket member is received, is also formed in top wall 18. As shown in FIG. 4, bottom wall 20 has a cut-away portion 30. Tabs 32 on top wall 18 and bottom wall 20 engage with appropriate portions of the socket member and thereby serve to retain the socket member within base 12.

Figure 2:
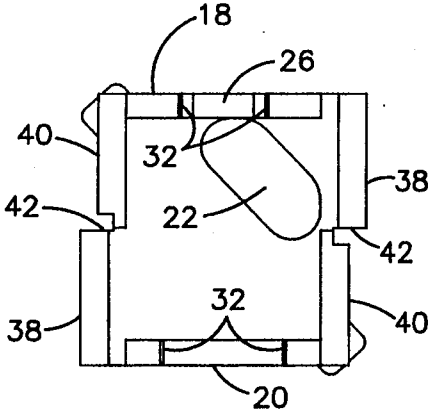
FIG. 2 is a front plan view of the modular connector shown in FIG. 1.

Side walls 24 are generally comprised of a first leg 34 and a second leg 36. Each first leg 34 extends forward from rear face 16 to a lesser extent that does each second leg 36. Each first leg has an outwardly extending tab portion 38 located at its lower-most end. As described hereinafter, tab portions 38 are adapted to interlock with structure with which the module 10 is employed, such as the rear of an outlet faceplate or a patch panel. Each second leg 36 has a foot portion 40 adapted to engage with structure to which module 10 is attached. As shown best in FIG. 2, first legs 34 are located at opposite corners of base portion 12. Second legs 36 are similarly oppositely arranged. Additionally, FIGS. 2 and 3 illustrate that, in the preferred embodiment, base portion 12 is geometrically configured such that an offset 42 is created.

It should be understood that base portion 12 of the present invention may take on various shapes and forms and that the foregoing is provided for illustrating the preferred embodiment of the present invention only, and is not intended as limiting. Base portion 12 is for supporting and retaining a socket member, and accordingly, could be constructed in a variety of manners. For instance, instead of the substantially open-ended box-like structure shown in FIG. 1, base portion 12 may comprise a channel-shaped member or any other suitable member for grasping the socket member. In this regard, the walls of base member 12 may be configured to appropriately engage a suitable modular jack of virtually any configuration.

Still with reference to FIGS. 1–6, reference numeral 14 generally denotes a connecting member located on rear face 16 of base portion 12 of module 10. Connecting member 14 is preferrably a connector base by AT&T known as a 110 connector base. Connecting member 14 comprises a row of posts 46 extending outwardly from rear face 16 of base portion 12. Preferably, posts 46 comprise two end posts 48 and a first set of tall posts 50 and a second set of short posts 52 such that each short post 52 is next to a tall post 50. In other words, between end posts 48, the row of posts 48 comprises an alternating arrangement of a tall post 50, followed by a short post 52, followed by a tall post 50, and so on. Slots 54 are located between posts 46. Additionally, channels 56 are provided in posts 46. Channels 56 extend from the top of each post 46 to the base thereof.

Figure 3:
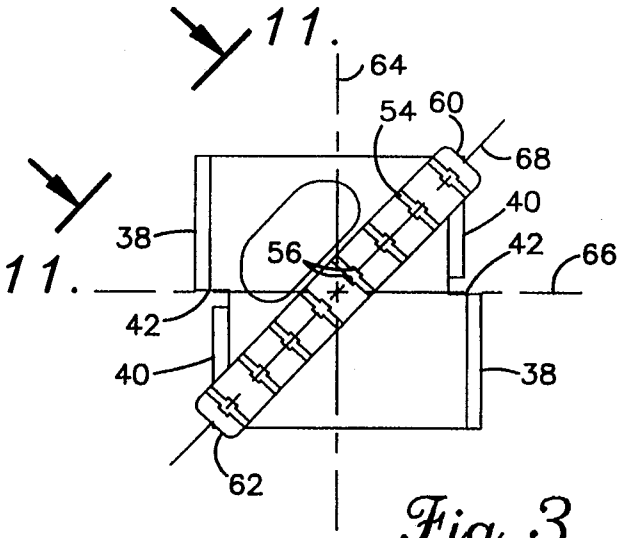
FIG. 3 is a rear plan view of the modular connector shown in FIG. 1.

As shown best in the top plan view of FIG. 3, connecting member 14 is preferably positioned diagonally across rear wall 16 of base portion 12 of module 10. Specifically, connecting member 16 has a longitudinal component, taken along the row of posts 46, that preferably extends substantially from one corner 60 of base portion 12 to the opposite corner 62 of base portion 10. More specifically, rear wall 16 may be defined as having a first axis 64 and a second axis 66 which is perpendicular to first axis 64. Connecting member 14 has a longitudinal axis 68 taken along substantially the center of the row of posts 46. In accordance with the present invention, longitudinal axis 68 of connecting member 14 is oriented at a first acute angle relative to first axis 64 and a second acute angle relative to second axis 66. Preferably, the first and second acute angles are substantially greater than zero degrees and substantially less than 90 degrees. Preferrably, the first and second angles are equal close to 45 degrees, and ideally, the first angle is approximately 43.2 degrees and the second angle is approximately 46.8 degrees.

In the preferred embodiment, the accessible socket opening of the modular jack housed within base portion 12 is oriented substantially symmetrically with respect to first axis 64 and second axis 66. In other words, as shown best in FIG. 7, first axis 64 and second axis 66 preferably define the orientation of the socket opening 72 of socket member 74 positioned within module 10. Accordingly, in accordance with the preferred embodiment of the present invention, longitudinal axis 68 of connecting member 14 is similarly oriented at a first acute angle and a second acute angle with respect to the orientation of the socket member 74 and its socket opening 76, as defined by first axis 64 and second axis 66, respectively. As discussed, the first and second acute angles are preferably substantially greater than zero degrees and substantially less than 90 degrees, and are preferrably close to 45 degrees, and ideally, the first angle is 43.2 degrees and the second angle is 46.8 degrees.

The foregoing described orientation of the row of posts 46 on module 10 optimizes space thereby reducing the space required to comprise module 10, particularly in the directions of first axis 64 and second axis 66. The described arrangement of the connecting member 14 in relation to the modular jack permits two modular connectors of the present invention to be located side-by-side on the rear of a faceplate in a standard sized electrical box of the type commonly used at outlets.

Turning now to FIGS. 7–10, module 10 is shown as used in combination with a faceplate 70 having cross bars 73 extending laterally across faceplate 70. Faceplate 70 has apertures 71 for receiving screws or the like for fastening faceplate 70 over a standard electrical box. A faceplate 70 has a plurality of openings 72 through each of which access may be made to a socket member 74 utilized with the present invention and located behind its associated opening 22 of faceplate 70. Socket member 74 has a socket opening 76 adapted to receive a modular plug (not shown). In the embodiment shown, faceplate 70 has six openings 72. It will be appreciated that a faceplate having a different number of openings may be utilized.

Figure 8:
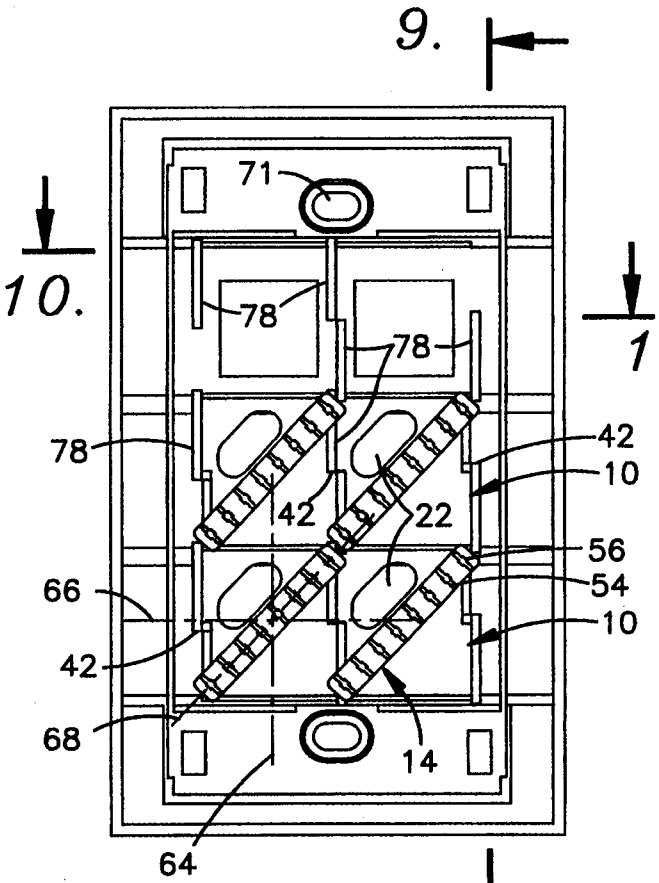
FIG. 8 is a rear elevational view of the faceplate shown in FIG. 7.
Figure 7:
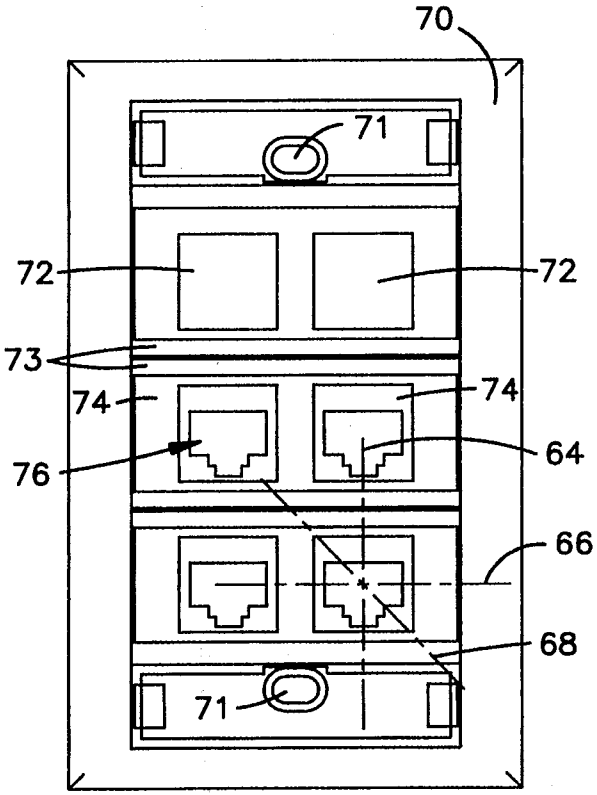
FIG. 7 is a front elevational view of a faceplate for a standard electrical box, which faceplate is used in conjuction with the present invention.

As shown in FIGS. 7 and 8, four of the six faceplate openings 72 have electrical connectors of the present invention associated therewith. Particularly, four modules 10 are positioned behind and associated aperture 72 and faceplate 70.

Figure 9:
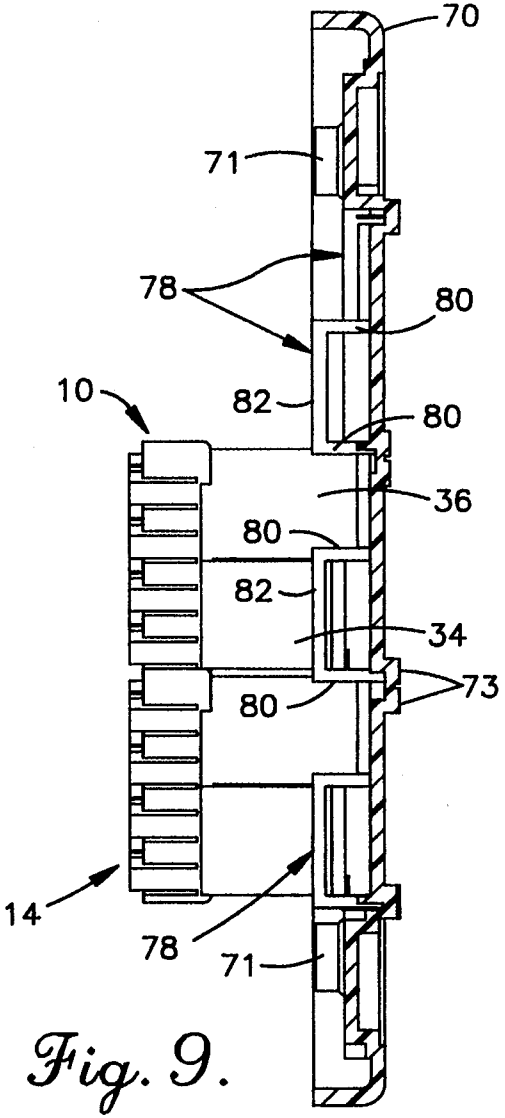
FIG. 9 is a sectional view taken along line 9—9 of FIG. 8.
Figure 10:
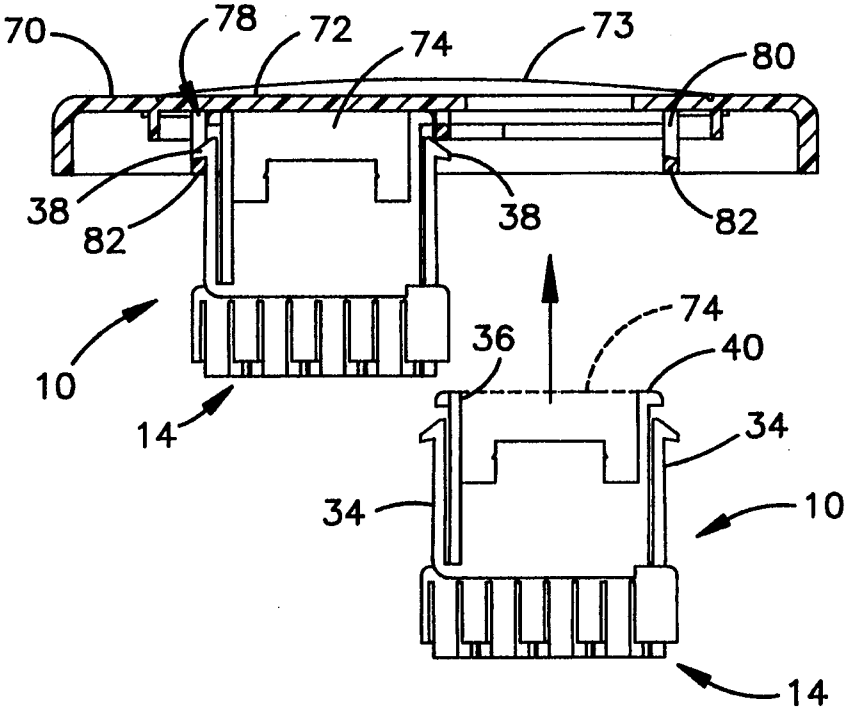
FIG. 10 is a sectional view taken along line 10—10 of FIG. 8 with a portion expanded therefrom.

Referring now to FIG. 10, a first module 10 is shown connected to the rear of faceplate 70. Socket member 74 is positioned such that socket opening 76 faces opening 72 of faceplate 70. Feet 40 at the ends of second leg members 36 engage the rear surface of faceplate 70 on opposite sides of opening 72. Tabs 38 at the end of first leg members 34 engage brackets 78 located on the rear of faceplate 70 for interlocking module 10 to faceplate 70. As shown in FIGS. 8 and 9, brackets 78 preferably comprise a bridge-shaped element having posts 80 extending outwardly from the rear of faceplate 70 and a bridge member 82 extending between posts 80. With reference again to FIG. 10, it is seen that tab 38 engages bridge element 82. Preferably, the mating edges of tab 38 and bridge element 82 of bracket 78 are tapered to resist removal of module 10 once it is snapped into place. It will be appreciated that the components of the present invention, and namely first leg members 34, are slightly flexible to permit them to be snap-fit into place.

A second module 10 in FIG. 10 is shown spatially removed from the of faceplate 70. This module 10 is shown with socket member 74 shown in phantom lines.

With reference again to FIG. 8, brackets 78 are uniquely arranged to cooperate with tabs 38 of first leg members 34 of module 10. Particularly, brackets 78 are arranged to permit the electrical connector of the present invention to be located side-by-side with a second electrical connector of the present invention behind a faceplate for covering a standard electrical box.

In accordance with the preferred embodiment of the present invention, module 10, and particularly tabs 34 thereof, engage with brackets 78 located near opposite corners of openings 72 of faceplate 70. Accordingly, the offset nature of module 10, as denoted by reference numeral 42, causes tabs 38 on first leg members 34 of module 10 to properly engage with an appropriate associated bracket 78.

As shown in FIG. 8, the electrical connector of the present invention permits an individual modular connector made in accordance with the principals of the present invention to be placed side-by-side on the rear of a faceplate, and accordingly, side-by-side in a standard electrical box utilized at an outlet. As seen, the angular relationship of connecting member 14 with respect to first and second axes 64 and 66, respectively, permits such an arrangement.

Figure 11:
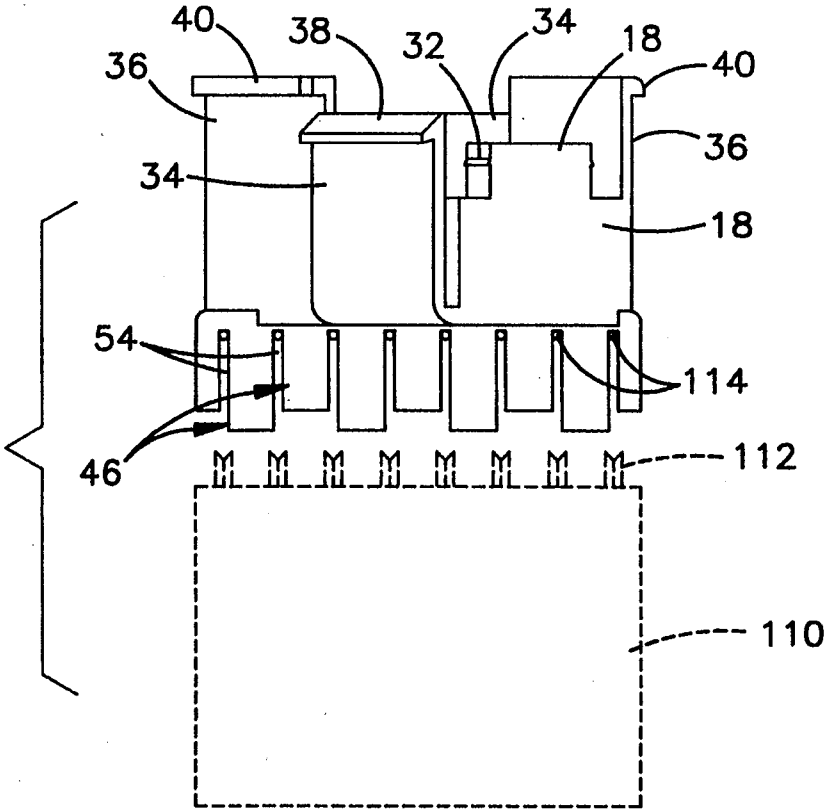
FIG. 11 is an elevational view taken along line 11—11 of FIG. 3 and showing a connecting block in phantom lines.

Connecting member 14 is utilized to support a connecting block of the type made by AT&T and known by the part series number 110, such as the 110c and 110d connecting blocks. As shown in FIG. 11, which is taken along line 11—11 of FIG. 3, connecting block 110 has a plurality of prongs 112 extending outwardly therefrom. When module 10 is fully assembled for use, with socket member 74 supported in base portion 12, wires 114 are appropriately connected between electrical contacts in socket member 74 and connecting block 110. Specifically, aperture 22 in rear face 16 of module 10 is for the purpose of passing therethrough wires 114 which are connected to the contacts within socket member 74. Knowledge of wiring a modular jack is within the ordinary skill of persons skilled in the modular connector art. More specifically, socket member 72 has therein a number of electrical contacts. Each electrical contact has a wire 114 connected thereto which is passed through aperture 22 in rear face 16 of module 10. Each wire 114 is threaded through an appropriate slot 54 between posts 46 of connecting member 14. It will be appreciated that each wire 114 may comprise a conductive element surrounded by insulative material, or be a bare conductive element. Connecting block 110, having outwardly extending prongs 112 thereon, is then positioned onto connecting member 14 such that the prongs 112 are received within slots 54 between posts 46. When sufficiently pressed together, prongs 112 of the connecting block 110 contact the wires 114 thereby providing an electrically conductive contact. It will be appreciated that the particular wiring scheme chosen is a design choice.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An electrical modular connector for use with a connecting block, said modular connector comprising:

a socket member having a face with a single opening therein, said opening adapted to receive a modular data communication plug, said socket member having a first axis and a second axis, whereby said first axis is perpendicular to said second axis;

retaining means for retaining said socket member such that said socket opening is accessible at a first side of said modular connector, said retaining means including a rear surface opposite said first side of said modular connector; and support means for supporting said connecting block, said supporting means being mounted on said rear surface and having opposite ends located immediately adjacent opposite sides of said single opening, said supporting means having a longitudinal axis extending between said ends and oriented at an acute angle relative to each of said first axis and said second axis.

2. The electrical connector as set forth in claim 1, said supporting means further comprising a row of posts between said ends extending outwardly from said retaining means, said posts adapted for coupling with said connecting block.

3. The electrical connector as set forth in claim 2, said row of posts having a longitudinal axis taken along substantially the center of said row of posts, said longitudinal axis oriented at an angle substantially greater than zero degrees and substantially less than ninety degrees relative to each of said first axis and said second axis.

4. The electrical connector as set forth in claim 1, said longitudinal axis oriented at substantially a forty-five degree angle relative to said first axis and said second axis.

5. The electrical connector as set forth in claim 1, said longitudinal axis oriented at a substantially 43 degree angle with respect to said first axis and substantially a 47 degree angle with respect to said second axis.

6. The electrical connector as set forth in claim 1, said retaining means further comprising:

a first face; and at least two parallel side walls extending from said first face for engaging with said socket member.

7. The electrical connector as set forth in claim 6, said first face having an aperture therein.

8. An electrical modular connector for use with a connecting block, said modular connector comprising:

a socket member having a face with a single opening therein, said opening adapted to receive a single modular data communication plug;

means for retaining said socket member such that said socket opening is accessible at a first side of said modular connector, said retaining means including side walls immediately adjacent opposite sides of said socket member and a surface opposite said first side of said modular connector, said opposite surface extending between said side walls, said retaining means having a first axis and a second axis, whereby said first axis is perpendicular to said second axis; and means for supporting a connecting block, said supporting means located on said opposite surface, said supporting means having opposite ends immediately adjacent said side walls and a longitudinal axis oriented at an acute angle relative to each of said first axis and said second axis.

9. The electrical connector as set forth in claim 8, said supporting means further comprising a row of posts extending outwardly from said retaining means, said posts adapted for coupling with said connecting block.

10. The electrical connector as set forth in claim 9, said row of posts having a longitudinal axis taken along substantially the center of said row of posts, said longitudinal axis oriented at an angle substantially greater than zero degrees and substantially less than ninety degrees relative to each of said first axis and said second axis.

11. The electrical connector as set forth in claim 8, said longitudinal axis oriented at substantially a forty-five degree angle relative to said first axis and said second axis.

12. The electrical connector as set forth in claim 8, said longitudinal axis oriented at substantially a forty-three degree angle relative to said first axis and substantially a forty-seven degree angle relative to said second axis.

13. An electrical modular connector for use with a connecting block, said modular connector comprising:

a socket member having a face with an opening therein, said opening adapted to receive a modular data communication plug, said socket member having a first axis and a second axis, whereby said first axis is perpendicular to said second axis;

means for retaining said socket member such that said socket opening is accessible at a first side of said modular connector, said retaining means including a surface opposite said first side of said modular connector; and means for supporting a connecting block, said supporting means located on said opposite surface, said supporting means having a longitudinal axis oriented at substantially a forty-five degree angle relative to each of said first axis and said second axis.

14. An electrical modular connector for use with a connecting block, said modular connector comprising:

a socket member having a face with an opening therein, said opening adapted to receive a modular data communication plug, said socket member having a first axis and a second axis, whereby said first axis is perpendicular to said second axis;

means for retaining said socket member such that said socket opening is accessible at a first side of said modular connector, said retaining means including:

a first face proximate said first side of said modular connector;

at least two parallel side walls extending from said first face for engaging said socket member; and a rear surface at a rear end of said side walls opposite said first face and said first side of said modular connector; and means for supporting a connecting block, said supporting means located on said opposite surface, said supporting means having a longitudinal axis oriented at an acute angle relative to each of said first axis and said second axis.

15. An electrical modular connector for use with a connecting block, said modular connector comprising:

a socket member having a face with an opening therein, said opening adapted to receive a modular data communication plug;

means for retaining said socket member such that said socket opening is accessible at a first side of said modular connector, said retaining means including a surface opposite said first side of said modular connector, said retaining means having a first axis and a second axis, whereby said first axis is perpendicular to said second axis; and means for supporting a connecting block, said supporting means located on said opposite surface, said supporting means having a longitudinal axis oriented at substantially a forty-five degree angle relative to each of said first axis and said second axis.

16. In an electrical connector and face plate assembly, said face plate covering a standard electrical box, said face plate having at least two openings therein located immediately adjacent one another in a side by side contiguous relationship, the improvement comprising:

at least two socket members, each of which is associated with a corresponding one of said openings in said face plate, each of said socket members having a single opening therein, which is adapted to receive a single data communications plug;

at least two modules, each of which secures a corresponding socket member to said face plate such that said openings in said socket members align with corresponding openings in said face plate, each of said modules having a rear wall defining first and second axes perpendicular to one another; and at least two connectors, each of which is adapted to receive a corresponding connecting block, each of said connectors being mounted upon a respective one of said rear walls at an angle relative to said first and second axes such that neighboring ends of adjacent connectors are located at opposite ends of adjacent sides of said rear walls to prevent interference between said neighboring ends when said modules are installed in said side by side contiguous relationship, whereby adjoining sides of said rear walls are located immediately adjacent one another.

17. In an electrical connector and face plate assembly, according to claim 16, said modules abutting against one another when mounted upon said face plate.

18. In an electrical connector and face plate assembly, according to claim 16, wherein a longitudinal axis of each connector is formed substantially a 45° angle with said first and second axes.

* * * * *